US008698688B2

(12) United States Patent
Chiu et al.

(10) Patent No.: US 8,698,688 B2
(45) Date of Patent: Apr. 15, 2014

(54) ANTENNA WITH IMPROVED HOLED SYSTEM GROUND PLANE

(75) Inventors: Tsung-Wen Chiu, Taipei County (TW); Fu-Ren Hsiao, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 409 days.

(21) Appl. No.: 13/153,142

(22) Filed: Jun. 3, 2011

(65) Prior Publication Data

US 2012/0169564 A1 Jul. 5, 2012

(30) Foreign Application Priority Data

Dec. 30, 2010 (TW) ..... 99146901 A

(51) Int. Cl.
*H01Q 1/48* (2006.01)

(52) U.S. Cl.
USPC ..... 343/848

(58) Field of Classification Search
USPC ..... 343/700 MS, 848
See application file for complete search history.

(56) References Cited

U.S. PATENT DOCUMENTS

| | | | | |
|---|---|---|---|---|
| 5,173,711 | A * | 12/1992 | Takeuchi et al. | 343/700 MS |
| 8,269,689 | B2 * | 9/2012 | Lin et al. | 343/848 |
| 2010/0013730 | A1 * | 1/2010 | Azhari | 343/848 |

* cited by examiner

*Primary Examiner* — Seung Lee
(74) *Attorney, Agent, or Firm* — Schmeiser, Olsen & Watts LLP

(57) ABSTRACT

An antenna with an improved holed system ground plane comprises a substrate, a radiation conductor member, a grounding member and a system ground plane. The radiation conductor member is arranged on the surface of the substrate. The grounding member is arranged on one edge of the substrate. The radiation conductor member is connected with the grounding member. The system ground plane is connected with one side of the grounding member. The system ground plane has at least one arbitrary-shaped hole. A radiation-enhancing filler is disposed in the arbitrary-shaped hole. The present invention solves the conventional problems that the system ground plane is drilled or cut to accommodate components and IC chips, keep away from wiring routes and avoid protrusions on the appearance, via disposing radiation-enhancing fillers in the arbitrary-shaped holes. Thereby is kept integrality of the system ground plane and promoted omnidirectionality of signal transmission.

7 Claims, 3 Drawing Sheets

ANTENNA WITH IMPROVED HOLED SYSTEM GROUND PLANE

BACKGROUND OF THE INVENTION

1. Field of the Invention

The present invention relates to an antenna with an improved holed system ground plane, particularly to an antenna design, wherein radiation-enhancing fillers are disposed in the holes of the system ground plane.

2. Description of the Related Art

As the wireless technology is more and more widely used, the physical wiring is gradually obsoleted. Meanwhile, the antennae are evolved to meet various requirements. In fact, the miniature antennae are the conventional dipole antennae whose appearance is modified into various shapes, such as a circle, an ellipse, a loop, a rectangle, a triangle, a polygon and an irregular shape, to form compact and slim antennae. The substrate of the miniature antenna usually adopts an FR4 glass-reinforced printed circuit board (PCB), which is generally used in various electronic products.

The antenna module using the FR4 glass-reinforced PCB is also called the printed antenna. The printed antennae may be categorized into the monopole type, the dipole type and the multipole type. When the substrate of the printed antenna is integrated with components and IC chips, the following factors should be taken into consideration: the characteristics of the antenna, the space occupied by components, and the transmission omnidirectionality of the radiation signals of the system ground plane.

How to integrate an antenna module with the hardware and firmware of a wireless communication device (such as the components, IC chips, wiring, and casing of the device) closely correlates with sales of the products. For an example, the radiation performance of the antenna modules should not be degraded when the antenna modules are arranged along the perimeter of the liquid crystal display of the portable computer. For another example, full miniaturization, high radiation efficiency and fine signal transmission omnidirectionality should be achieved when several antenna modules are integrated with the components, IC chips, wiring, system ground plane, etc. of a handheld phone.

SUMMARY OF THE INVENTION

One objective of the present invention is to provide an antenna with an improved holed system ground plane, wherein radiation-enhancing fillers are disposed in the holes of the system ground plane to prevent from shrinkage of the region where the grounding member connects with the system ground plane, keep the integrality of the system ground plane, increase the radiation efficiency of the antenna system, and maintain the transmission omnidirectionality of the radiation signal of the system ground plane.

Another objective of the present invention is to provide an antenna with an improved holed system ground plane characterized in that the holes, which has been cut or drilled on the system ground plane, are filled with radiation-enhancing fillers to maintain the integrality of the system ground plane, whereby the grounding member is completely joined to the system ground plane, and whereby uneven current distribution is avoided.

To achieve the abovementioned objectives, the present invention proposes an antenna with an improved holed system ground plane, which comprises a substrate, a radiation conductor member, a grounding member and a system ground plane. The radiation conductor member is arranged on the surface of the substrate. The grounding member is arranged on one edge of the substrate. The radiation conductor member is connected with the grounding member. The system ground plane is connected with one edge of the grounding member. The system ground plane has at least one arbitrary-shaped hole, and a radiation-enhancing filler is disposed in the arbitrary-shaped hole.

The present invention solves the problem: the conventional technology has to form holes on the system ground plane to accommodate components and IC chips and avoid protrusions on appearance, keeping away from wiring routes. The present invention disposes radiation-enhancing fillers in the arbitrary-shaped holes of the system ground plane to keep the integrality of the system ground plane and improve the radiation efficiency of the antenna system. Although the components are integrated with the system ground plane, the present invention can simultaneously keep the superior performance of the antenna system, reduce the space occupied by the components, and maintain the omnidirectionality of the radiation signals of the system ground plane.

Although holes are cut or drilled on the system ground plane, the present invention can keep the integrality of the system ground plane and avoid uneven current distribution via filling radiation-enhancing fillers into the holes of the system ground plane.

Below, the embodiments are described in detail to make easily understood the technical contents of the present invention.

DETAILED DESCRIPTION OF THE INVENTION

Figure 1:
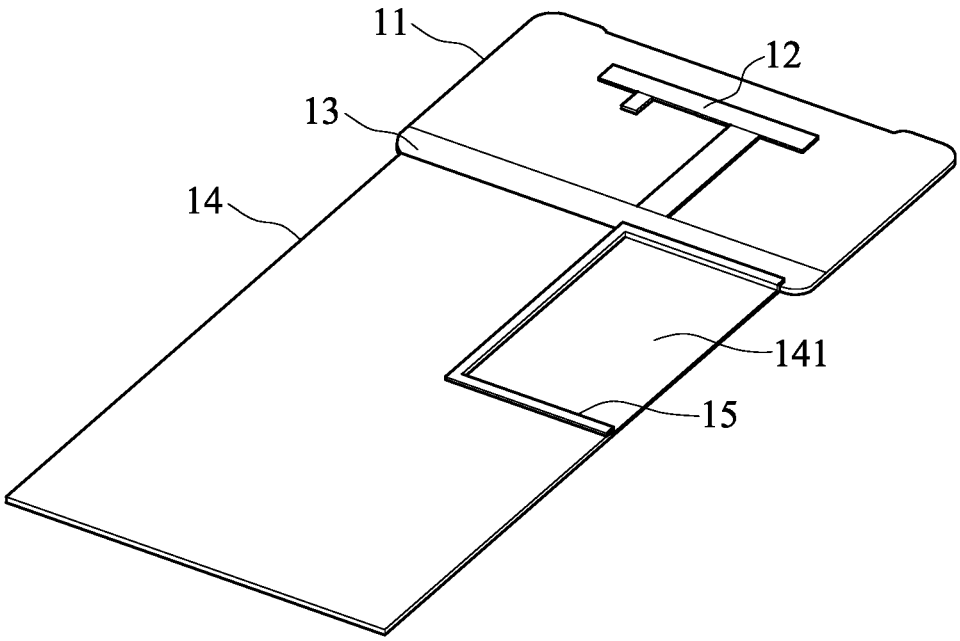
FIG. 1 is an assembly drawing of an antenna with an improved holed system ground plane according to a first embodiment of the present invention.
Figure 2:
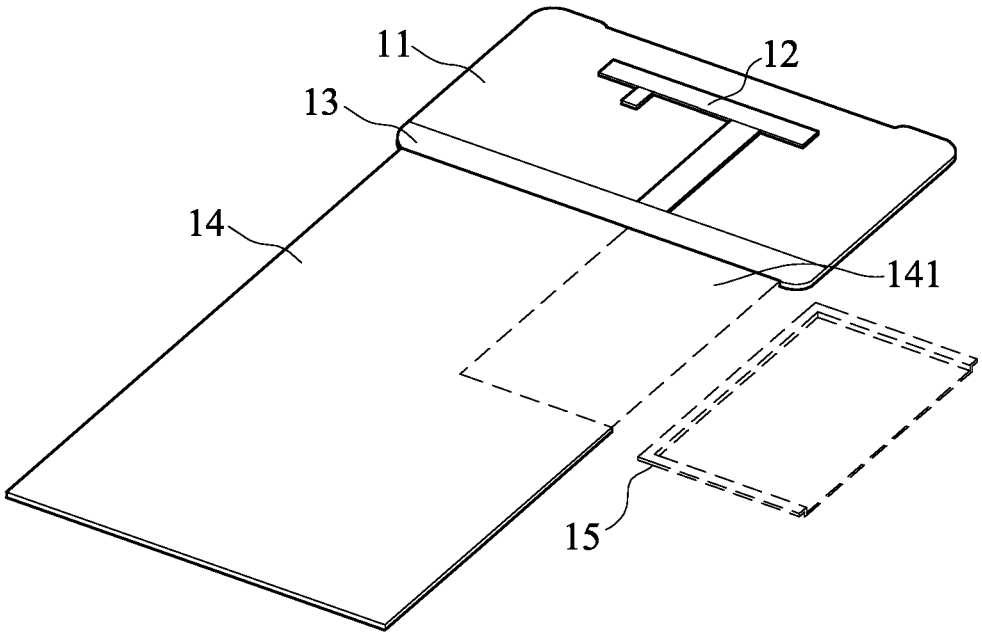
FIG. 2 is an exploded view of an antenna with an improved holed system ground plane according to a first embodiment of the present invention.

Refer to FIG. 1 and FIG. 2 respectively an assembly drawing and an exploded view of an antenna with an improved holed system ground plane according to a first embodiment of the present invention. The antenna with an improved holed system ground plane comprises a substrate 11, a radiation conductor member 12, a grounding member 13 and a system ground plane 14. The system ground plane 14 has at least one arbitrary-shaped hole 141, and a radiation-enhancing filler 15 is disposed in the arbitrary-shaped hole 141.

The radiation conductor member 12 is arranged on the surface of the substrate 11. The grounding member 13 is arranged on one edge of the substrate 11. The radiation conductor member 12 is connected with the grounding member 13. The system ground plane 14 is connected with one side of the grounding member 13 and extends far away from the substrate 11. The grounding member 13 conducts the grounded signals to the system ground plane 14. The arbitrary-shaped hole 141 is formed at the center or the edge of the system ground plane 14. The arbitrary-shaped hole 141 may be an arbitrary shape, such as a rectangle, a triangle, a circle, a polygon, or an irregular shape. No matter what shape the arbitrary-shaped hole 141 is, the radiation-enhancing filler 15 can always be assembled to the arbitrary-shaped hole 141 of the system ground plane 14 via soldering, covering or sticking. The arbitrary-shaped hole 141 can be directly connected with the grounding member 13 to make the system ground plane 14 a continuous extension from the grounding member 13, whereby the current generated by the grounding member 13 distributes more uniformly.

In one embodiment, the substrate 11 has a rectangular shape and has a length of about 43 mm, a width of about 20 mm and a thickness of about 1 mm. The radiation conductor member 12 has a small rectangular feeder segment and an L-like radiation conductor. The rectangular feeder segment has a length of about 3 mm and a width of about 2 mm. The rectangle of the L-like radiation conductor, which contacts the feeder segment, has a length of about 2 mm and a width of about 2 mm. The rectangle of the L-like radiation conductor, which contacts the grounding member 13, has a length of about 14 mm and a width of about 3 mm. The grounding member 13 is a long rectangle having a length of about 43 mm and a width of about 3 mm. The system ground plane 14 is a rectangle having a length of about 52 mm and a width of about 43 mm. The arbitrary-shaped hole 141 is a rectangle with a length of about 22 mm and a width of about 12 mm. The radiation-enhancing filler 15 has a rectangular shape with a length of about 26 mm and a width of about 14 mm.

Figure 3:
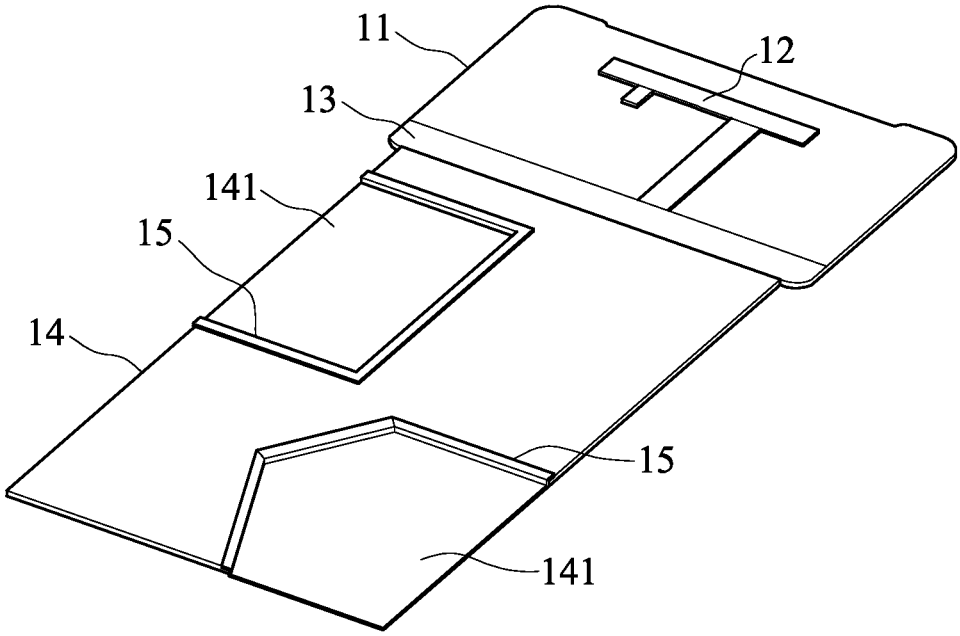
FIG. 3 is an assembly drawing of an antenna with an improved holed system ground plane according to a second embodiment of the present invention.

Refer to FIG. 3 an assembly drawing of an antenna with an improved holed system ground plane according to a second embodiment of the present invention. The second embodiment is basically similar to the first embodiment but different from the first embodiment in that a metallic radiation-enhancing filler 15 in form of a metallic sheet or a metallic foil is disposed in the arbitrary-shaped hole 141 via soldering/covering the metallic sheet on the system ground plane 14 or sticking a copper/aluminum foil to the system ground plane 14. In this embodiment, the arbitrary-shaped hole 141 may be a rectangle, a triangle, a circle, a polygon, or an irregular shape; the system ground plane 14 has one or more arbitrary-shaped holes 141. Thereby is kept integrality of the system ground plane 14, improved uneven current distribution on the grounding member 13, and achieved superior radiation performance of the antenna system.

Figure 4:
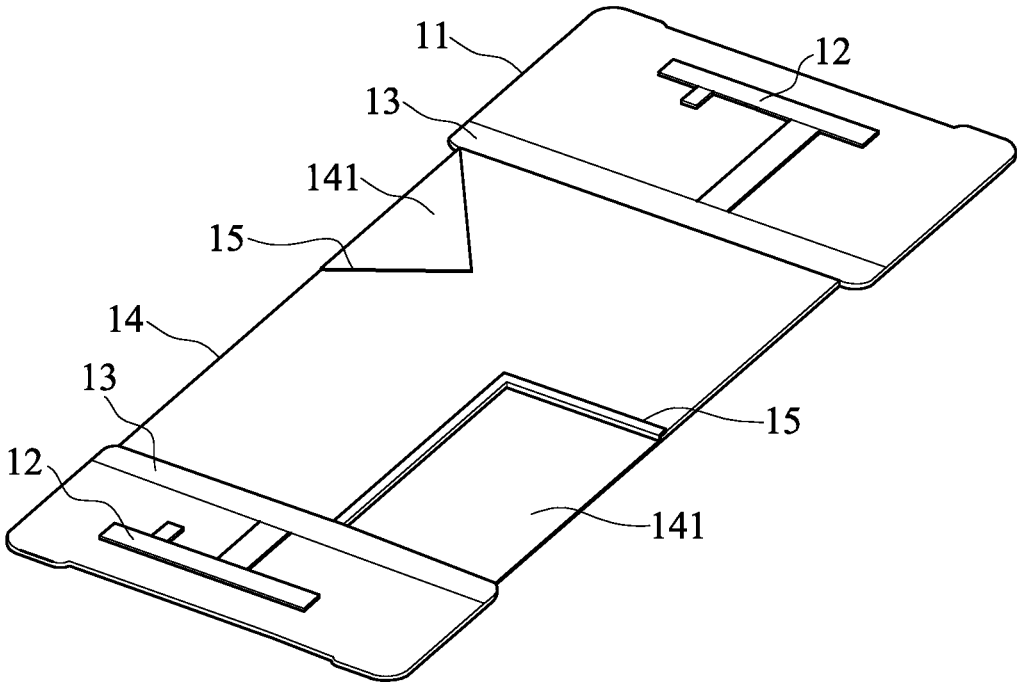
FIG. 4 is an assembly drawing of an antenna with an improved holed system ground plane according to a third embodiment of the present invention.
Figure 5:
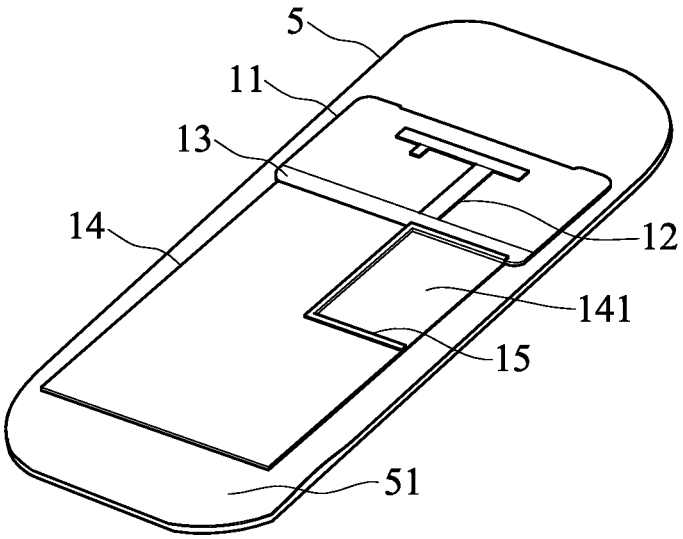
FIG. 5 is a top view schematically showing that an antenna with an improved holed system ground plane is applied to a mobile phone according to the first embodiment of the present invention.

Refer to FIG. 4 an assembly drawing of an antenna with an improved holed system ground plane according to a third embodiment of the present invention. The third embodiment is basically similar to the first embodiment but different from the first embodiment in that the radiation-enhancing fillers 15 are disposed in at least two arbitrary-shaped holes 141 and that the present invention is applied to at least two antenna modules. As shown in FIG. 4, the radiation-enhancing fillers 15 are disposed in the regions adjacent to the junctions between the grounding members 13 and the system ground plane 14. Thereby is avoided disconnection between the grounding member 13 and the system ground plane 14, kept integrality of the system ground plane 14, and achieved uniformity of the current distribution on the grounding member 13. Refer to FIG. 5 a top view schematically showing that an antenna with an improved holed system ground plane is applied to a mobile phone according to the first embodiment of the present invention. When the present invention is applied to a mobile phone 5, the substrate 11, the radiation conductor member 12, the grounding member 13, the system ground plane 14 and the radiation-enhancing filler 15 are sequentially arranged on the casing 51 of the mobile phone 5. The radiation-enhancing filler 15 is disposed in the arbitrary-shaped hole 141 of the system ground plane 14 to keep integrality of the system ground plane 14, improve radiation efficiency of the antenna system, and maintain transmission omnidirectionality of the radiation signals of the system ground plane 14. From the above description, it is known that the present invention possesses utility, novelty and non-obviousness and meets the condition for a patent. Thus, the Inventor files the application for a patent. It will be appreciated if the patent is approved fast.

The embodiments described above are only to exemplify the present invention but not to limit the scope of the present invention. Any equivalent modification or variation according to the scope of the present invention is to be also included within the scope of the present invention.

What is claimed is:

1. An antenna with an improved holed system ground plane, comprising a substrate;

a radiation conductor member arranged on said substrate;

a grounding member arranged on an edge of said substrate and connected with said radiation conductor member; and a system ground plane connected with one side of said grounding member and having at least one arbitrary-shaped hole, wherein a radiation-enhancing filler is disposed in said arbitrary-shaped hole.

2. The antenna with an improved holed system ground plane according to claim 1, wherein said arbitrary-shaped hole is in form of a rectangle, a triangle, a circle, a polygon, or an irregular shape.

3. The antenna with an improved holed system ground plane according to claim 1, wherein said arbitrary-shaped hole is connected with said grounding member.

4. The antenna with an improved holed system ground plane according to claim 1, wherein said radiation-enhancing filler is made of a metallic material.

5. The antenna with an improved holed system ground plane according to claim 1, wherein said radiation-enhancing filler is assembled to said system ground plane via a soldering method, a covering method, or an adhesive method.

6. The antenna with an improved holed system ground plane according to claim 5, wherein said radiation-enhancing filler is in form of a metallic sheet and soldered to, overlaid on, or stuck to said system ground plane.

7. The antenna with an improved holed system ground plane according to claim 5, wherein said radiation-enhancing filler is in form of a copper foil or an aluminum foil and stuck to said system ground plane.

* * * * *